US007362059B2

(12) United States Patent
Park

(10) Patent No.: US 7,362,059 B2
(45) Date of Patent: Apr. 22, 2008

(54) DRIVING UNIT OF FLUORESCENT LAMP AND METHOD FOR DRIVING THE SAME

(75) Inventor: Hee Jeong Park, Bucheon-shi (KR)

(73) Assignee: LG.Philips LCD Co., Ltd., Seoul (KR)

( * ) Notice: Subject to any disclaimer, the term of this patent is extended or adjusted under 35 U.S.C. 154(b) by 58 days.

(21) Appl. No.: 11/105,585

(22) Filed: Apr. 14, 2005

(65) Prior Publication Data

US 2005/0237009 A1 Oct. 27, 2005

(30) Foreign Application Priority Data

Apr. 14, 2004 (KR) ..... 10-2004-0025780

(51) Int. Cl.
*H05B 37/02* (2006.01)

(52) U.S. Cl. ..... 315/291; 315/312; 315/313

(58) Field of Classification Search ..... 315/291, 315/307, 313, 152, 252
See application file for complete search history.

(56) References Cited

U.S. PATENT DOCUMENTS

| | | | | |
|---|---|---|---|---|
| 5,574,336 | A | 11/1996 | Konopka et al. | |
| 5,718,418 | A * | 2/1998 | Gugsch | 267/140.14 |
| 6,023,131 | A * | 2/2000 | Okita | 315/291 |
| 6,727,754 | B2 * | 4/2004 | Dupuis et al. | 330/254 |
| 6,803,901 | B1 * | 10/2004 | Numao | 345/102 |
| 7,227,316 | B2 * | 6/2007 | Lu | 315/308 |
| 2001/0012087 | A1 * | 8/2001 | Sasuga et al. | 349/149 |
| 2002/0130628 | A1 | 9/2002 | Shin | |
| 2002/0163822 | A1 | 11/2002 | Lin | |
| 2004/0141343 | A1 | 7/2004 | Lin | |
| 2004/0232853 | A1 * | 11/2004 | Hur et al. | 315/291 |
| 2005/0111237 | A1 * | 5/2005 | Moon et al. | 362/561 |
| 2005/0116662 | A1 * | 6/2005 | Sanchez | 315/225 |
| 2005/0253537 | A1 * | 11/2005 | Jang et al. | 315/307 |
| 2006/0226800 | A1 * | 10/2006 | Bruning | 318/280 |

FOREIGN PATENT DOCUMENTS

| | | |
|---|---|---|
| CN | 1431644 | 7/2003 |
| EP | 0 920 052 A1 | 6/1999 |
| JP | 06-203983 | 7/1994 |
| JP | 2000-182791 | 6/2000 |
| WO | WO 0179922 | 10/2001 |
| WO | WO 2004/072733 | 8/2004 |

OTHER PUBLICATIONS 2004-312565, Jun. 2002, Derwent, Samsung Electronics Co.*
Combined Search and Examination Report issued on Jun. 30, 2005, by the United Kingdom Patent Office.
Preliminary Search Report issued by the French Patent Office on Nov. 15, 2006.

* cited by examiner

*Primary Examiner*—Trinh Vo Dinh
(74) *Attorney, Agent, or Firm*—McKenna Long & Aldridge, LLP

(57) ABSTRACT

A fluorescent lamp driving unit includes fluorescent lamps, wherein each fluorescent lamp includes a first end and a second end opposing the first end; an inverter for driving the plurality of fluorescent lamps to emit light; and a controller for electrically connecting and disconnecting the plurality of fluorescent lamps to and from the inverter.

14 Claims, 8 Drawing Sheets

DRIVING UNIT OF FLUORESCENT LAMP AND METHOD FOR DRIVING THE SAME

This application claims the benefit of Korean Patent Application No. P2004-25780, filed on Apr. 14, 2004, which is hereby incorporated by reference for all purposes as if fully set forth herein.

BACKGROUND OF THE INVENTION

1. Field of the Invention

The principles of the present invention generally relate to liquid crystal display (LCD) devices. More particularly, the principles of the present invention relate to a fluorescent lamp driving unit and a method for driving the same, wherein the fluorescent lamp driving unit is capable of independently driving individual fluorescent lamps within a backlight unit.

2. Discussion of the Related Art

As information communication technology continues to develop, display devices become more important. Traditionally, cathode ray tubes (CRTs) have been used as display devices due to their ability to display color images at a high brightness. Compared to other, more recently developed types of flat display devices however, CRTs are relatively large and heavy. Therefore, many applications substitute CRTs for flat panel displays (e.g., liquid crystal display (LCD) devices, electroluminescent display (ELD) devices, plasma display panels (PDPs), etc.) that have large display areas, slim profile, high resolution, and are lightweight. Such flat panel displays have been developed for use as monitors for computers, spacecraft, and aircraft.

Due to their ability to efficiently display bright, moving images at high resolutions using relatively low driving voltages (and thus low power consumption) LCD devices are extensively researched and implemented in various applications.

A typical LCD device includes an LCD panel that display images by manipulating anisotropic optical characteristics of liquid crystal material contained therein. The optical characteristics of liquid crystal material are voltage-dependent. Accordingly, when predetermined voltages are applied to liquid crystal material of individual pixels, the polarization characteristics of each pixel are manipulated so as to transmit a predetermined of light that is incident to the LCD panel, thereby displaying an image. By themselves, LCD panels do not generate light that is necessary to display images. Therefore, to display images, light must be generated by a light source that is external to the LCD panel. Depending upon the light source used to display images, LCD devices may generally be classified as being either reflective- or transmissive-type LCD devices.

Reflective-type LCD devices use ambient light as a light source but have several drawbacks as the brightness of the images displayed depends on the brightness of light in the surrounding environment. Transmissive-type LCD devices, however, incorporate backlight units which contain a light source (e.g., electro-luminescent (EL) source, light-emitting diode (LED), cold cathode fluorescent lamp (CCFL), hot cathode fluorescent lamp (HCFL), etc.). Due to their thin profile and low power consumption, CCFLs are widely used as light sources in backlight units.

If AC power is directly applied to a plurality of CCFLs connected in parallel, only some of the CCFLs will be driven at one time. Thus, and to simultaneously drive the plurality of CCFLs connected in parallel, each CCFL must undesirably be connected to its own inverter (i.e., a power source).

To overcome the disadvantageous use of CCFLs within backlight units, backlight units may be provided with external electrode fluorescent lamps (EEFLs) as the light source, wherein such backlights generally include a plurality of EEFLs connected in parallel. Contrary to CCFLs, a plurality of EEFLs connected in parallel may be driven using a single inverter (i.e., power source)

FIG. 1 illustrates a block diagram of a related art LCD device.

Referring to FIG. 1, a related art LCD device includes an LCD panel 11, a data driver 11*b*, a gate driver 11*a*, a timing controller 13, a power source 14, a gamma reference voltage part 15, a DC/DC converter 16, a backlight 18, and an inverter 19. The LCD panel 11 displays images and includes a thin film transistor (TFT) array substrate, a color filer array substrate, and a liquid crystal layer between the TFT and color filter array substrates. The TFT array substrate includes a plurality of gate lines G and a plurality of data lines D while the color filter array substrate includes a color filter layer. The data driver 11*b* supplies data signals to each data line D and the gate driver 11*a* supplies scanning pulses to each gate line G. The timing controller 13 receives graphic information (e.g., R, G, and B data), vertical and horizontal synchronizing signals $V_{sync}$ and $H_{sync}$, a clock signal DCLK, and a control signal DTEN output by a liquid crystal module (LCM) driving system 17. The timing controller 13 also formats the received display data, the clock and control signals at a predetermined timing value to drive the gate driver 11*a* and the data driver 11*b* to effect the display of images. The power source 14 supplies a voltage to the timing controller 13, the data driver 11*b*, the gate driver 11*a*, the gamma reference voltage part 15, and the DC/DC converter 16. The gamma reference voltage part 15 receives the voltage supplied by the power source 14 and generates suitable reference voltages corresponding to analog data output by the data driver 11*b*, wherein the analog data is generated in association with the digital data output by the timing controller 13. The DC/DC converter 16 receives the voltage supplied by the power source 14 and generates a constant voltage $V_{DD}$, a gate high voltage $V_{GH}$, a gate low voltage $V_{GL}$, a reference voltage $V_{ref}$, and a common voltage $V_{com}$ to various components of the LCD panel 11. The backlight unit 18 includes a light source for emitting light to the LCD panel 11 and the inverter 19 drives the backlight unit 18.

A more detailed description of the backlight unit 18 and the inverter 19 will now be provided with respect to FIG. 2, illustrating a circuit diagram of a related art inverter used in driving a fluorescent lamp.

Referring to FIG. 2, the related art inverter includes a transformer T1, a high-frequency oscillation circuit 25, a first transistor Q1, a pulse width modulation (PWM) controller 24, and a power switch 26. The transformer T1 is connected to one end of a fluorescent lamp 10 included within the backlight unit 18 while the high-frequency oscillation circuit 25 is connected to a primary coil L1 of the transformer T1. The first transistor Q1 is connected between the high-frequency oscillation circuit 25 and a voltage source Vin such that the first transistor Q1 transmits a voltage output by the voltage source Vin to the high-frequency oscillation circuit 25. The PWM controller 24 supplies a control signal to the first transistor Q1 while the power switch 26 is connected between the PWM controller 24 and the voltage source Vin.

The transformer T1 includes the primary coil L1, a secondary coil L2, and an auxiliary coil L3. The primary and auxiliary coils L1 and L3, respectively, are connected to the high-frequency oscillation circuit 25. Accordingly, a first end of the secondary coil L2 is connected to the end of the fluorescent lamp, generically referred to at reference numeral 10, via the first capacitor C1 and a second end of the secondary coil L2 is connected to a grounding voltage source GND.

The high-frequency oscillation circuit 25 includes second and third transistors Q2 and Q3, respectively, and a second capacitor C2 connected in parallel to the primary coil L1, wherein the second and third transistors Q2 and Q3 are n-type and p-type transistors, respectively. The grounding voltage source GND is provided between the second and third transistors Q2 and Q3 and the second and third transistors Q2 and Q3 apply the voltage to the primary coil L1 according to the inputted AC voltage.

Collector terminals of the second and third transistors Q2 and Q3 are connected to opposing ends of the primary coil L1, emitter terminals of the second and third transistors Q2 and Q3 are commonly connected to the grounding voltage source GND, and base terminals of the second and third transistors Q2 and Q3 contact the central point of the primary coil L1 via first and second resistances R1 and R2.

Furthermore, a coil is connected between the collector terminal of the first transistor Q1 and the high-frequency oscillation circuit 25 while a first diode D1 is connected between the collector terminal of the first transistor Q1 and the grounding voltage source GND. Moreover, a synchronizing signal controller 28 is provided between the PWM controller 24 and a first node N1, wherein the first node N1 is formed between the coil and the first transistor Q1.

Upon activating the power switch 26, the PWM controller 24 receives a feedback current FB from the fluorescent lamp 10 and supplies a predetermined PWM control signal to the base terminal of the first transistor Q1. At this time, the PWM control signal controls a switching period of the first transistor Q1 according to the feedback current FB.

The first transistor Q1 is turned on and off in accordance with the PWM control signal output by the PWM controller 24. Accordingly, a voltage provided from the voltage source Vin and having a pulse width modulated by the PWM control signal is supplied to the high-frequency oscillation circuit 25. The coil removes the noise from the voltage transmitted by the first transistor Q1 and the first diode D1 prevents the voltage from flowing to the grounding voltage source GND. The synchronizing signal controller 28 receives the voltage signal having the noise removed by feedback and, in turn, generates a synchronizing signal for determining an output point of the PWM control signal outputted from the PWM controller 24. The synchronizing signal controller 28 then outputs the synchronizing signal to the PWM controller 24.

A detailed description of a first related art fluorescent lamp driving unit will now be provided with respect to FIG. 3.

Referring to FIG. 3, a related art fluorescent lamp driving unit includes a plurality of fluorescent lamps, herein provided as CCFLs 31, and a plurality of the aforementioned inverters 19. The plurality of CCFLs 31 are spaced apart from each other within the backlight unit 18 at a fixed distance to uniformly emit light. Moreover, each of the plurality of inverters 19 are connected with corresponding ones of the CCFLs 31 to apply driving signals to individual ones of the CCFLs 31, thereby individually driving corresponding ones of the CCFLs 31. Referring to FIG. 4, electrodes 33 are formed at opposing ends of each CCFL 31. Accordingly, each of the plurality of inverters 19 are connected with the electrodes 33 of each CCFL 31, enabling each CCFL 31 to be independently driven as desired. As discussed above, CCFLs 31 within the aforementioned backlight unit 18 can only be simultaneously driven when they are connected to their own inverter 19. However, driving each CCFL 31 using a unique inverter 19 can undesirably increase the cost of fabricating and maintaining the related art fluorescent lamp driving unit shown in FIG. 3 as the number of CCFLs contained within the backlight unit 18 increases.

Thus, and with reference to FIG. 5, a second related art fluorescent lamp driving unit replaces the CCFLs 31 with EEFLs 41. As shown in FIG. 5, a plurality of EEFLs 41 are spaced apart from each other within the backlight unit 18 at a predetermined distance. Because common external electrodes 42 (i.e., external electrodes of adjacent EEFLs 41 that are electrically connected to each other) are formed at both ends of each EEFL 41, the EEFLs 41 can be connected to each other in parallel and be driven using only one inverter 19. Accordingly, one inverter 19 can be used to simultaneously drive each EEFL 41. Referring to FIG. 6 common external electrodes 42 cover both ends of the EEFLs 41 and one inverter 19 is connected with the common external electrodes 42 of the EEFLs 41, to simultaneously drive the plurality of EEFLs 41.

When used in applications such as televisions, it is generally known that liquid crystal material within LCD devices can have a relatively slow response time, resulting in a blurring phenomenon of moving images. To overcome this disadvantage, driving techniques such as overdriving, and backlight modulation techniques such as flashing, data blinking, and scanning, have been developed. According to the overdriving method, data signals having higher values than preset data signals are applied to mitigate the effects of a slow response time of the liquid crystal material. According to the flashing method, the backlight unit is turned on and off in each frame to emulate the impulsive characteristics of CRTs. According to the scanning method, the backlight unit is turned on and off in synchrony with the application of a gate signal in one frame. Because the EEFLs 41 in the related art fluorescent lamp driving unit shown in FIG. 5 are driven using the same inverter 19, it is impossible to apply the aforementioned backlight modulation techniques.

SUMMARY OF THE INVENTION

Accordingly, the present invention is directed to a driving unit of fluorescent lamp and a method for driving the same that substantially obviates one or more of the problems due to limitations and disadvantages of the related art.

An advantage of the present invention provides a fluorescent lamp driving unit and a method for driving the same, wherein a switching device is provided between an inverter and each fluorescent lamp to independently drive individual fluorescent lamps, thereby facilitating the implementation of backlight modulation techniques.

Additional features and advantages of the invention will be set forth in the description which follows, and in part will be apparent from the description, or may be learned by practice of the invention. These and other advantages of the invention will be realized and attained by the structure particularly pointed out in the written description and claims hereof as well as the appended drawings.

To achieve these and other advantages and in accordance with the purpose of the present invention, as embodied and broadly described, a fluorescent lamp driving unit may, for example, include a plurality of fluorescent lamps, wherein each fluorescent lamp includes a first end and a second end opposing the first end; an inverter for driving the plurality of fluorescent lamps to emit light; and a controller for electrically connecting and disconnecting the plurality of fluorescent lamps to and from the inverter.

In another aspect, a fluorescent lamp driving unit may, for example, include a plurality of fluorescent lamps, wherein each fluorescent lamp includes first and second ends; a plurality of first external electrodes formed at the first ends, wherein the first external electrodes are not electrically connected to each other; a plurality of second external electrodes formed at the second ends wherein the second external electrodes are electrically connected to each other; an inverter connected to the first and second external electrodes to drive the fluorescent lamps to emit light; a plurality of switching devices connected between the inverter and each first external electrode to selectively drive the plurality of fluorescent lamps according to control signals; and a switching controller for outputting the control signals.

In another aspect, a method for driving a backlight unit may, for example, include generating control signals associated with graphic information generated in a timing controller of a liquid crystal display (LCD) device; amplifying the generated control signals; transmitting the amplified control signals; and electrically connecting at least one fluorescent lamp to an inverter upon receipt of the transmitted control signals such that the at least one fluorescent lamp emits light.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE ILLUSTRATED EMBODIMENTS

Reference will now be made in detail to an embodiment of the present invention, example of which is illustrated in the accompanying drawings.

Figure 7:
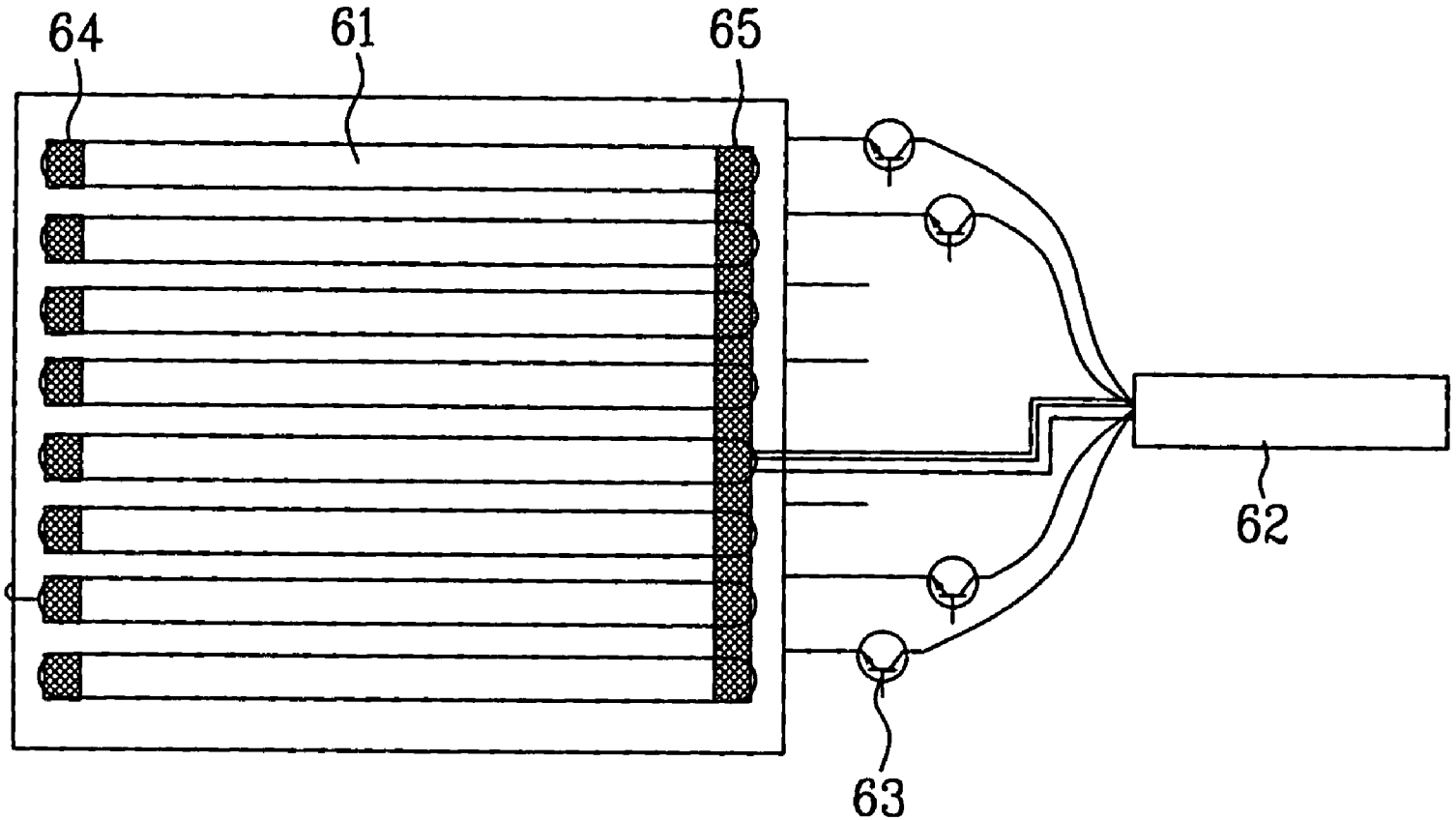
FIG. 7 illustrates a fluorescent lamp driving unit in accordance with principles of the present invention.
Figure 8:
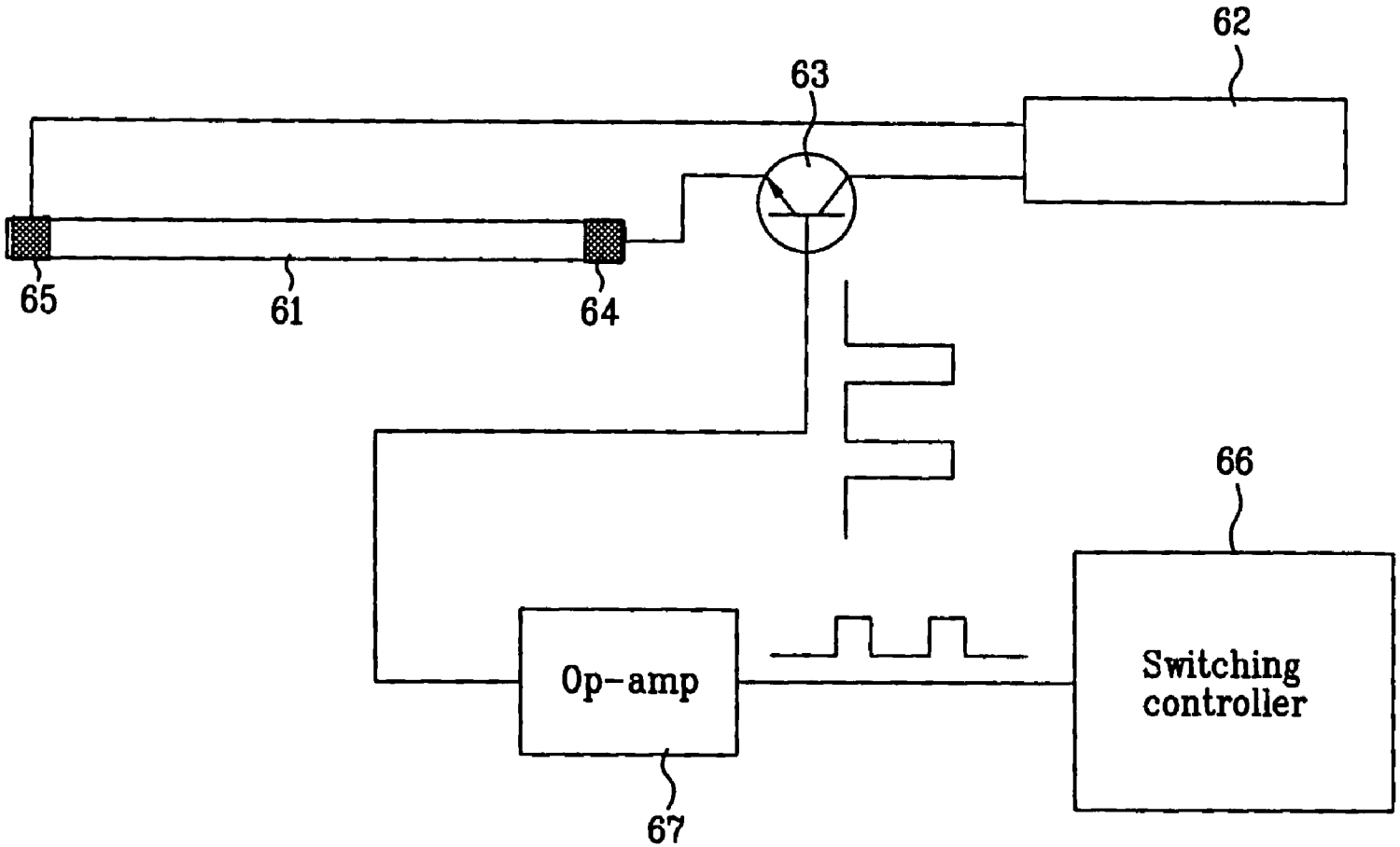
FIG. 8 illustrates the fluorescent lamp driving unit shown in FIG. 7.

FIG. 7 illustrates a fluorescent lamp driving unit in accordance with principles of the present invention. FIG. 8 illustrates the fluorescent lamp driving unit shown in FIG. 7.

Referring to FIGS. 7 and 8, a fluorescent lamp driving unit according to principles of the present invention may, for example, include a backlight unit and a driving unit.

In one aspect of the present invention, the backlight unit may, for example, include a plurality of fluorescent lamps 61. In another aspect of the present invention, the plurality of fluorescent lamps 61 may be provided as external electrode fluorescent lamps (EEFLs) 61. For example, each fluorescent lamp 61 may include a suitably transparent glass tube, a fluorescent material coated on an interior surface of the tube, and a discharge gas provided within the tube. In yet another aspect of the present invention, the plurality of fluorescent lamps 61 may be spaced apart from each other within the backlight unit at a predetermined distance and may be driven to emit light.

In one aspect of the present invention, the driving unit may, for example, include an inverter 62, a plurality of switching devices 63, a switching controller 66, and at least one OP-amp 67. The inverter 62 may, for example, be electrically connected to the plurality of fluorescent lamps 61 and may apply driving signals suitable for driving the plurality of fluorescent lamps 61 to emit light. The plurality of switching devices 63 may, for example, be connected between the inverter 62 and an end of the plurality of fluorescent lamps 61. Further, and as will be discussed in greater detail below, the plurality of switching devices 63 may receive control signals output by the OP-amp 67 and, in response to the control signals, may electrically connect the plurality of fluorescent lamps 61 to the inverter 62. Accordingly, each of the plurality of switching devices 63 may selectively connect a corresponding fluorescent lamp 61 to the inverter 62, enabling the corresponding fluorescent lamp 61 to be driven to emit light.

Figure 1:
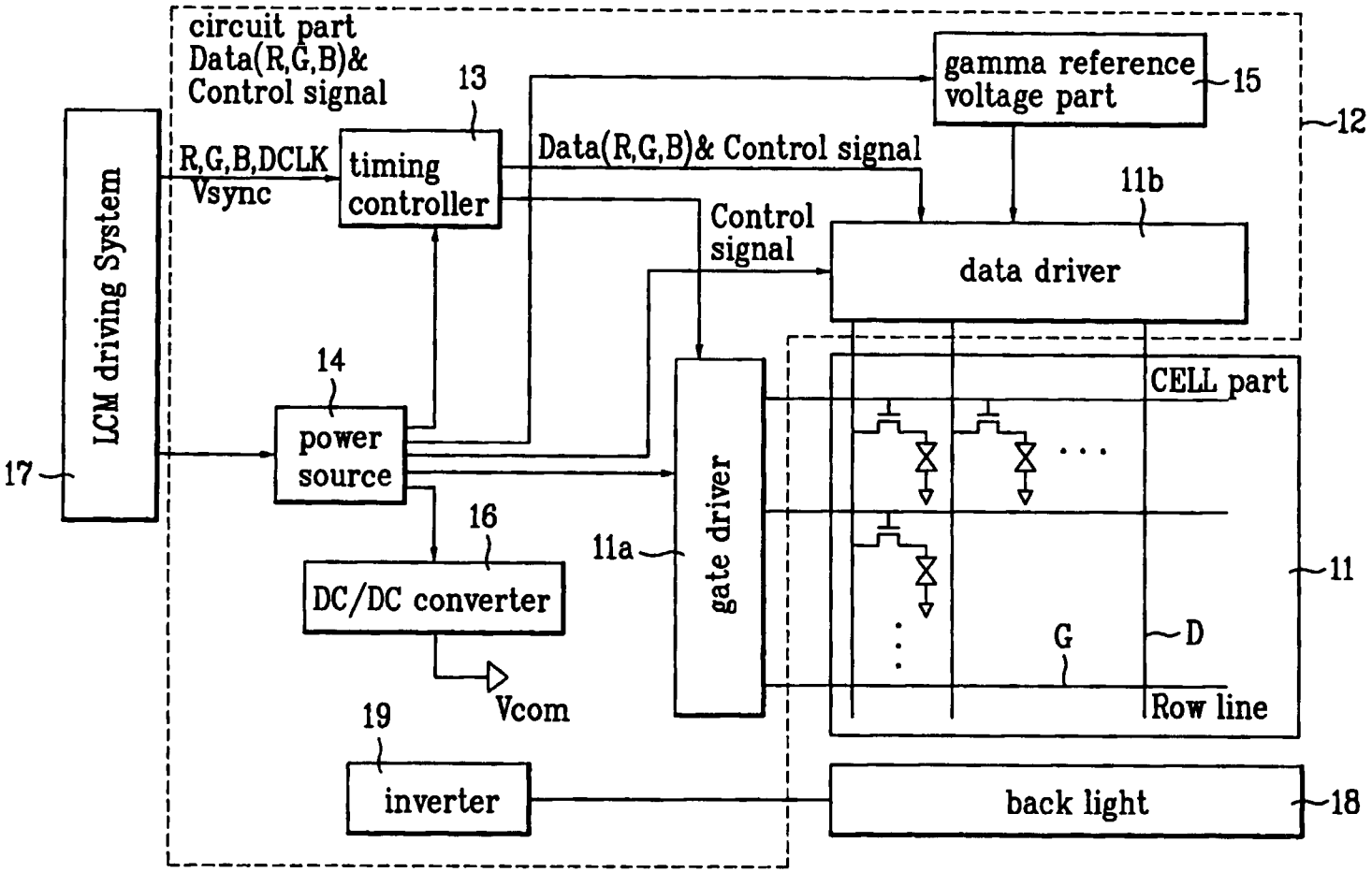
FIG. 1 Related Art
FIG. 1 illustrates a block diagram of a related art LCD device.
Figure 2:
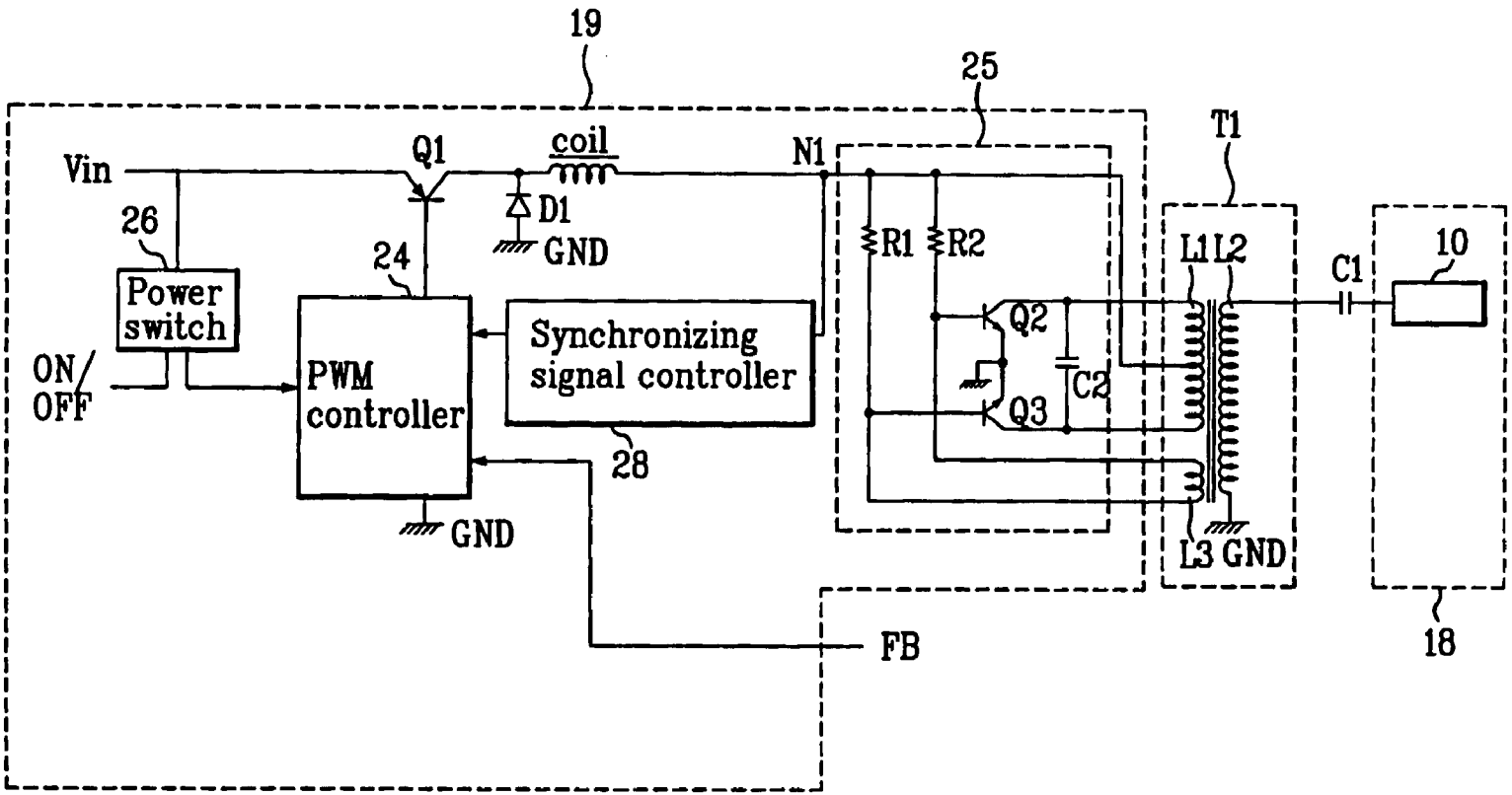
FIG. 2 Related Art
FIG. 2 schematically illustrates a related art inverter used to drive a fluorescent lamp.
Figure 3:
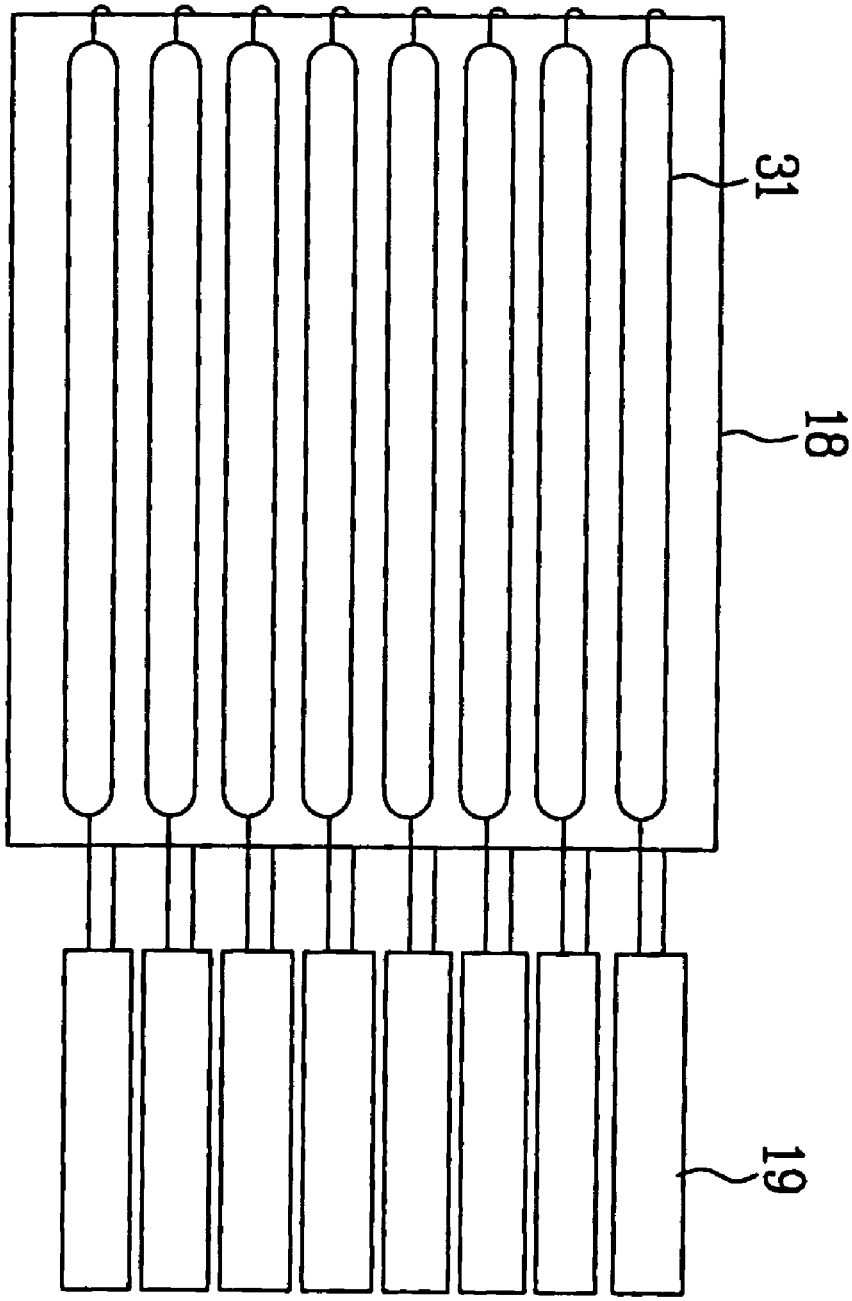
FIG. 3 Related Art
FIG. 3 schematically illustrates a first related art fluorescent lamp driving unit including a plurality of CCFLs.
Figure 4:
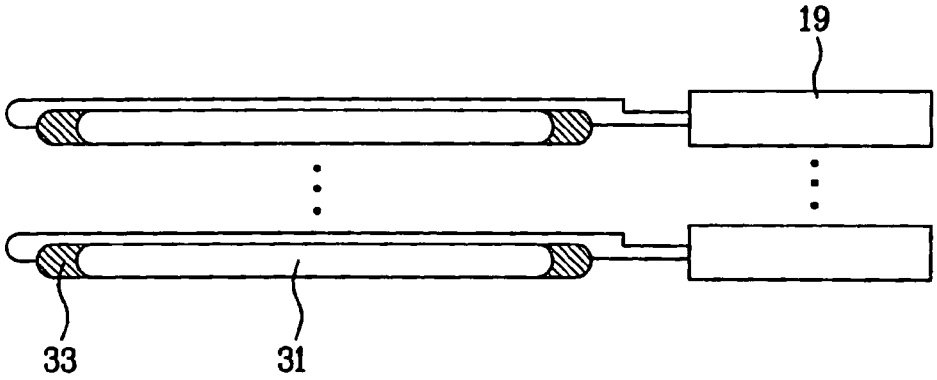
FIG. 4 Related Art
FIG. 4 illustrates a connection between the CCFL and the inverter shown in FIG. 3.
Figure 5:
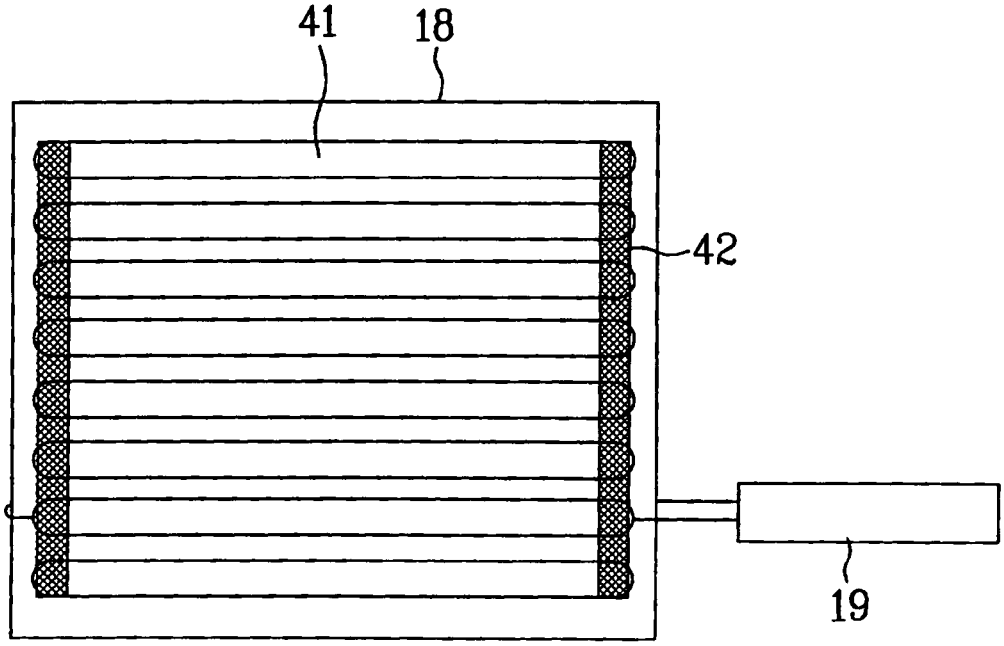
FIG. 5 Related Art
FIG. 5 schematically illustrates a second related art fluorescent lamp driving unit including a plurality of EEFLs.
Figure 6:
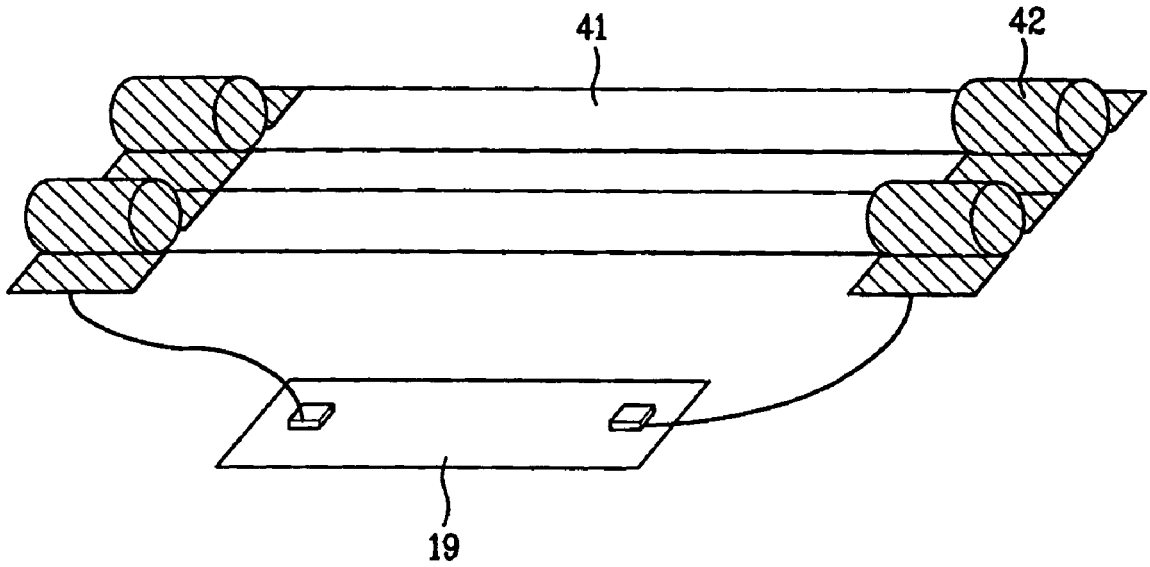
FIG. 6 Related Art
FIG. 6 illustrates a connection between the EEFL and the inverter shown in FIG. 5.

According to principles of the present invention, each switching device 63 may controlled to activate and deactivate respective ones of the fluorescent lamps 61 in synchrony with graphic information generated, for example, by a timing controller such as that shown in FIG. 1. In one aspect of the present invention, the number of the switching devices 63 within the fluorescent lamp driving unit may be identical to the number of the fluorescent lamps 61 contained within the backlight unit. In another aspect of the present invention, each switching device 63 may, for example, be provided as an NPN- or PNP-type transistor. In yet another aspect of the present invention, each switching device 63 may, for example, be provided as an NMOS- or PMOS-type transistor. In still another aspect of the present invention, each fluorescent lamp 61 may, for example, include a first end and a second end opposing the first end. Each first end may, for example, be provided with an individual external electrode 64 (i.e., an external electrode that is not electrically connected to an external electrode of an adjacent fluorescent lamp 61) and each second end may, for example, be provided with a common external electrode 65 (i.e., an external electrode that is electrically connected to an external electrode of an adjacent fluorescent lamp 61). In still a further aspect of the present invention, the individual and common external electrodes 64 and 65 may be formed of a material such as aluminum (Al), copper (Cu), silver (Ag), or the like, or alloys thereof.

Referring to FIG. 8, the inverter 62 may be electrically connected between the individual and common external electrodes 64 and 65, respectively, of each fluorescent lamp 61. Moreover, each switching device 63 may be electrically connected to a corresponding individual external electrode 64 provided at the first end of each fluorescent lamp 61 and an output terminal of the inverter 62. In one aspect of the present invention, the operation of each switching device 63 may be ultimately controlled by the switching controller 66. In another aspect of the present invention, the switching controller 66 may be controlled by an externally applied control signal generated, for example, by a device such as the timing controller shown in FIG. 1. In yet another aspect of the present invention, the OP-amp 67 may be connected between the switching controller 66 and each switching device 63 to amplify signals generated, and output from, the switching controller 66. For example, a single OP-amp 67 may be provided between the switching controller 66 and an input junction of the plurality of switching devices 63. Alternatively, a plurality of OP-amps 67 may be provided wherein one OP-amp 67 is provided between an input of a corresponding switching device 67 and the switching controller 66.

An operation of the fluorescent lamp driving unit according to principles of the present invention will now be described in greater detail.

First, the switching controller 66 may generate a control signal having a first voltage level and the OP-amp 67 may receive the generated control signal. Then, the OP-amp 67 may amplify the received control signal and output an amplified control signal having a second voltage level, wherein the second voltage level is greater than the first voltage level. Subsequently, the amplified control signal is transmitted to each switching device 63. The switching device 63 may be selectively turned on or off in accordance with the amplified control signal output by the OP-amp 67. Thus, when each switching device 63 is turned on by the amplified control signal, the switching device 63 applies a driving signal generated by the inverter 62 to a corresponding fluorescent lamp 61, thereby driving the corresponding fluorescent lamp 61.

According to principles of the present invention, the switching controller 66 may, for example, be provided as a microcomputer. In one aspect of the present invention, the switching controller 66 may maintain information specific to each fluorescent lamp 61. In another aspect of the present invention, the control signal generated by the switching controller 66 may correspond to predetermined switching devices 63. Accordingly, the control signal generated by the switching controller 66, and amplified by the OP-amp 67, may selectively turn on and off predetermined switching devices 63, thereby selectively activating predetermined fluorescent lamps 61.

Figure 9:
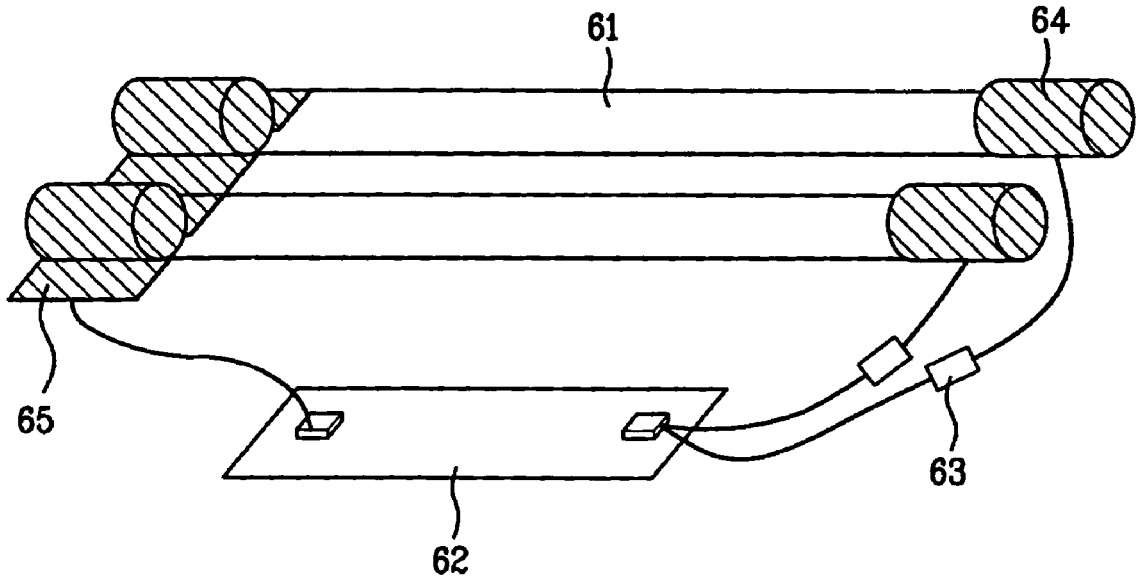
FIG. 9 illustrates a connection between a fluorescent lamp and an inverter according to principles of the present invention.

FIG. 9 illustrates a connection between a fluorescent lamp and an inverter according to principles of the present invention.

Referring to FIG. 9, and as discussed above, the plurality of fluorescent lamps 61 may be spaced apart from each other within a backlight unit at a predetermined distance. Moreover, each fluorescent lamp 61 may, for example, include a first end and a second end opposing the first end. Each first end may, for example, be provided with an individual external electrode 64 (i.e., an external electrode that is not electrically connected to an external electrode of an adjacent fluorescent lamp 61) and each second end may, for example, be provided with a common external electrode 65 (i.e., an external electrode that is electrically connected to an external electrode of an adjacent fluorescent lamp 61). In one aspect of the present invention, the inverter 62 may be electrically connected between the individual and common external electrodes 64 and 65, respectively, of each fluorescent lamp 61. Moreover, each switching device 63 may be electrically connected to a corresponding individual external electrode 64 provided at the first end of each fluorescent lamp 61 and an output terminal of the inverter 62.

As discussed above, the fluorescent lamp driving unit, and method for driving the same, advantageously enables the selective and independent driving of individual EEFLs connected in parallel, thereby facilitating the implementation of backlight modulation techniques to improve the quality of motion images displayed by an LCD device.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A driving unit of fluorescent lamp, comprising:

a plurality of fluorescent lamps, wherein each fluorescent lamp includes a first end and a second end opposing the first end;

a single inverter for driving the plurality of fluorescent lamps to emit light, the inverter including an output terminal;

a plurality of switching devices, wherein each switching device is electrically connected between the first end of each fluorescent lamp and the output terminal of the inverter; and a switching controller for electrically connecting and disconnecting the plurality of fluorescent lamps to and from the inverter, for generating a control signal, and for outputting the generated control signal to the plurality of switching devices, wherein the single inverter drives respectively all of the fluorescent lamps connected with the switching devices controlled by the same switching controller.

2. The driving unit of claim 1, further comprising at least one OP-amp for amplifying the generated control signal and for outputting the amplified control signal to at least one of the plurality of switching devices.

3. The driving unit of claim 1, wherein the at least one switching device is provided as an NPN-, a PNP-, an NMOS-, or a PMOS-type transistor.

4. The driving unit of claim 1, further comprising a timing controller of a liquid crystal display (LCD) device connected to an input of the switching controller for generating an external control signal according to graphic information and outputting the external control signal to the switching controller.

5. The driving unit of claim 1, wherein the switching controller comprises a microcomputer.

6. The driving unit of claim 1, wherein the number of the fluorescent lamps is equal to the number of the switching devices.

7. The driving unit of claim 1, wherein the plurality of fluorescent lamps comprise external electrode fluorescent lamps (EEFLs).

8. The driving unit of claim 1, wherein each of the plurality of fluorescent lamps comprises:

a first external electrode formed at the first end; and a second external electrode formed at the second end, wherein first external electrodes of adjacent fluorescent lamps are not electrically connected to each other and wherein second external electrodes of adjacent fluorescent lamps are electrically connected to each other.

9. A driving unit of fluorescent lamp, comprising:

a plurality of fluorescent lamps, wherein each fluorescent lamp includes first and second ends;

a plurality of first external electrodes formed at the first ends, wherein the first external electrodes are not electrically connected to each other;

a plurality of second external electrodes formed at the second ends wherein the second external electrodes are electrically connected to each other;

a single inverter connected to the first and second external electrodes to drive the fluorescent lamps to emit light;

a plurality of switching devices connected between an output terminal of the inverter and each first external electrode to selectively drive the plurality of fluorescent lamps according to control signals; and a switching controller for outputting the control signals, wherein the single inverter drives respectively all of the fluorescent lamps connected with the switching devices controlled by the same switching controller.

10. The driving unit of claim 9, further comprising at least one OP-amp for amplifying the control signal and for outputting the amplified control signal to at least one of the plurality of switching devices.

11. The driving unit of claim 9, further comprising a timing controller connected to an input of the switching controller, wherein the control signals are generated in association with a signal output by the timing controller such that the plurality of fluorescent lamps are driven in synchrony with graphic information generated by the timing controller.

12. The driving unit of claim 9, wherein the plurality of fluorescent lamps includes a first fluorescent lamp, a second fluorescent lamp, a third fluorescent lamp and a fourth fluorescent lamp.

13. The driving unit of claim 10, wherein the at least one OP-amp is connected between the switching controller and the plurality of switching devices.

14. The driving unit of claim 13, wherein the at least one OP-amp includes a plurality of OP-amps each between an input of a corresponding switching device and the switching controller.

* * * * *